US005493773A

United States Patent [19]

Stroobant

[11] Patent Number: 5,493,773

[45] Date of Patent: Feb. 27, 1996

[54] APPARATUS FOR WIRING AN ELECTRICAL CONNECTOR

[75] Inventor: Alfons Stroobant, Bornem, Belgium

[73] Assignee: Framatome Connectors International, Paris, France

[21] Appl. No.: 303,223

[22] Filed: Sep. 8, 1994

[30] Foreign Application Priority Data

Sep. 14, 1993 [NL] Netherlands ..... 9301586

[51] Int. Cl.[6] ..... H01R 43/04

[52] U.S. Cl. ..... 29/748; 29/566.3; 29/749

[58] Field of Search ..... 29/33 M, 33 F, 29/566.2, 566.3, 748, 749, 757, 759, 760, 857; 7/107

[56] References Cited

U.S. PATENT DOCUMENTS

| | | | |
|---|---|---|---|
| 3,742,571 | 7/1973 | Brehm | 29/751 X |
| 3,995,358 | 12/1976 | Long et al. | 29/749 X |
| 4,422,235 | 12/1983 | Becker et al. | 29/749 |
| 4,642,874 | 2/1987 | Litehizer, Jr. | 29/566.4 |
| 4,831,727 | 5/1989 | Johnson, Jr. et al. | 29/566.3 X |
| 4,881,321 | 11/1989 | Komuro | 29/857 X |
| 4,974,311 | 12/1990 | Tran | 29/749 X |
| 5,079,827 | 1/1992 | Meyer | 29/566.3 |
| 5,333,376 | 8/1994 | Lawruk | 29/749 X |

FOREIGN PATENT DOCUMENTS

| | | | |
|---|---|---|---|
| 089779 | 9/1983 | European Pat. Off. | 29/749 |
| 0105045 | 4/1984 | European Pat. Off. . | |
| 305307 | 3/1989 | European Pat. Off. | 29/748 |
| 0385642 | 5/1990 | European Pat. Off. . | |
| 1386277 | 3/1975 | United Kingdom | 29/749 |

*Primary Examiner*—Peter Vo
*Attorney, Agent, or Firm*—Perman & Green

[57] ABSTRACT

An apparatus for wiring an electrical connector with two or more rows of subsequent contacts, in particular a connector of the IDC type, comprises a movable holder for the connector, at least one tool for applying a wire in a contact of the connector aligned with the tool, said tool being movable back and forth transverse to said holder, and means for moving the holder insteps in such a manner that a contact of the connector is aligned with the tool after each step. The apparatus further comprises a first guiding element having a base face with at least one guiding slot for guiding the projecting contact pin parts of a row of contacts of a connector to be wired and located in said holder, said guiding slot extending in the direction of movement of the holder above the holder, a front guiding face for guiding a wire to be connected, said guiding face extending transverse to the holder along at least the width of the holder between two subsequent contacts of a row of contacts one of these two contacts being aligned with the tool and having its contact pin portion extending into the corresponding guiding slot, and a side guiding face joining the front guiding face for guiding the wire to be connected, said side guiding face substantially extending in the direction of movement of the holder and extending from the base face with the guiding slot(s) obliquely upwardly and away from the holder.

4 Claims, 2 Drawing Sheets

APPARATUS FOR WIRING AN ELECTRICAL CONNECTOR

BACKGROUND OF THE INVENTION

The invention relates to an apparatus for wiring an electrical connector with two or more rows of subsequent contacts, in particular a connector of the IDC type, comprising a movable holder for the connector, at least one tool for applying a wire in a contact of the connector aligned with the tool, said tool being movable back and forth transverse to said holder, and means for moving the holder in steps in such a manner that a contact of the connector is aligned with the tool after each step.

Such an apparatus is known in different embodiments, see for example EP-A-0 105 045 and US-A-3 742 571. The known apparatus is only suitable for wiring a standard connector of the IDC type. In other types of connectors it is known to make the connector as a so-called stackable connector, wherein the contacts of the connector each are provided with a projecting contact pin part so that a second connector can be plugged onto the first connector. Up to the present it is not possible to make a connector of the IDC type as a stackable connector and to wire the same with the known apparatus.

The invention aims to provide an apparatus of the above-mentioned type which is adapted in a simple matter for wiring a connector of the IDC type made as a stackable connector.

SUMMARY OF THE INVENTION

To this end the apparatus of the above-mentioned type is characterized by a first guiding element having a base face with at least one guiding slot for guiding the projecting contact pin parts of a row of contacts of a connector to be wired and located in said holder, said guiding slot extending in the direction of movement of the holder above the holder, a front guiding face for guiding a wire to be connected, said guiding face extending transverse to the holder along at least the width of the holder between two subsequent contacts of a row of contacts one of these two contacts being aligned with the tool and having its contact pin portion extending into the corresponding guiding slot, and a side guiding face joining the front guiding face for guiding the wire to be connected, said side guiding face substantially extending in the direction of movement of the holder and extending from the base face with the guiding slot(s) obliquely upwardly and away from the holder.

In this manner it is obtained, that the known apparatus is suitable for wiring the stackable connector of the IDC type by adding a guiding element. The guiding slots support the contact pin parts during applying the different wires, while the guiding faces provide for a correct guiding of the wires to be connected.

This embodiment of the apparatus is suitable for wiring connectors of the IDC type wherein the wires of the cable extend to the contacts from one longitudinal side of the connector.

According to the invention it is also possible to wire a connector of the IDC type wherein the wires extend along a central part of the connector between the rows of contacts starting from the apparatus of the above-mentioned type by the application of two mirror symmetrical first guiding elements each having a base face with at least one guiding slot for guiding the projecting contact pin parts of a row of contacts of a connector to be wired and located in the holder, said guiding slot extending in the direction of movement of the holder above the holder, a front guiding face for guiding a wire to be connected, said guiding face extending transverse to said holder between two subsequent contacts of a row of contacts, one of these two contacts being aligned with the tool and having its contact pin part extending into the corresponding guiding slot, wherein said guiding elements have facing side guiding faces each joining the corresponding front guiding face and determining together a feeding slot for wires to be connected, said feeding slot being located substantially centrally above the holder.

In both embodiments it is preferred that a second somewhat L-shaped guiding element is provided at each first guiding element, a short leg of said guiding element being directed towards the first guiding element and provided with a guiding face for guiding a wire to be connected which is guided along the guiding faces of the first guiding element, towards a position aligned with the tool, said guiding face being staggered transverse to the holder with respect to the front guiding face of the corresponding first guiding element and being directed opposite to this first guiding face.

The apparatus described has the important advantage that by adding relatively simple guiding elements existing apparatus can be adapted for wiring stackable connectors of the IDC type. To this end the invention also provides two guiding elements the first guiding element being characterized by a base face with at least one guiding slot for guiding contact pin parts, a front guiding face and a side guiding face joining said front guiding face for guiding wires to be connected. The second guiding element is characterized in that the guiding element is made somewhat L-shaped and is provided with a guiding face for guiding wires to be connected.

BRIEF DESCRIPTION OF THE INVENTION

The invention will be further explained hereinafter by reference to the drawings in which two embodiments of the apparatus according to the invention are very schematically shown.

DETAILED DESCRIPTION OF THE PREFERRED EMBODIMENTS

Figure 1:
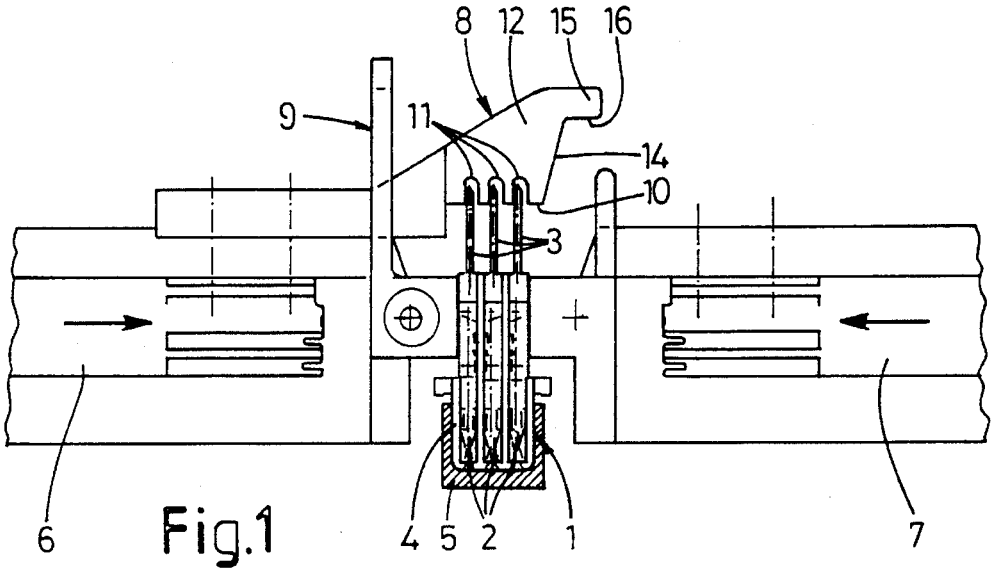
FIG. 1 shows rather schematically a front view of a first embodiment of the apparatus according to the invention.
Figure 2:
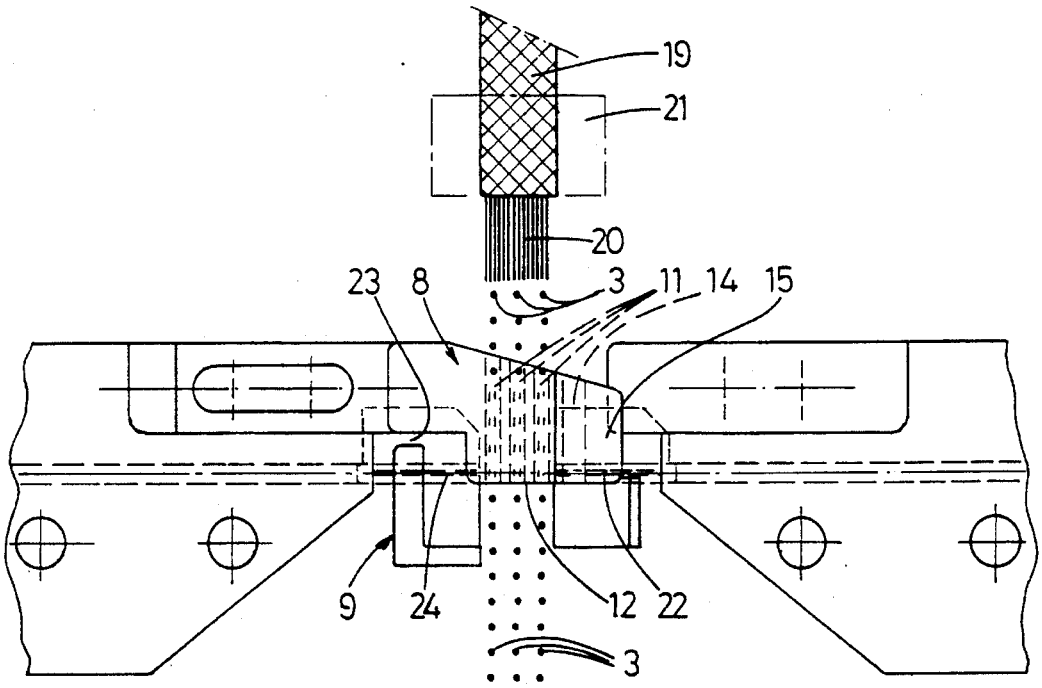
FIG. 2 is a partially shown top view of the apparatus of FIG. 1.

FIGS. 1 and 2 show an apparatus for wiring an electrical so-called stackable connector 1 of the IDC type, wherein the connector 1 is shown partially in cross-section in the very schematical front view of FIG. 1. The connector as shown has three rows of IDC-contacts 2 each being provided with a projecting contact pin part 3. A second connector can be plugged onto these contact pin parts 3. The left row of contacts 2 are part of a separate connector part 4 which is mounted in the connector 1 only after wiring the central row of contacts 2.

The apparatus described comprises a moveable holder 5 for the connector 1 and two tools 6, 7 for applying a wire in a contact 2 of the connector 1 aligned with the tool, said tools 6, 7 being moveable back and forth transverse to the holder 5. The tools 6, 7 are driven in a manner known per se by means not further shown. Further the apparatus comprises means for moving the holder 5 with the connector 1 located in the same in steps in such a manner that contacts 2 of the connector 1 are aligned with the tools 6, 7 after each step. As far as described now the apparatus is known so that details will not be explained further.

According to the invention the apparatus is provided with a first guiding element 8 and second guiding element 9. The first guiding element 8 comprises a base face 10 with three guiding slots 11 for guiding the projecting contact pin parts 3 of the rows of contacts 2 of the connector 1 placed in the holder 5. To this end the guiding slots 11 are located above the holder 5 and extend in the direction of movement of the holder 5. It is noted that the guiding element 8 can also be provided with two or more than three guiding slots.

Further the first guiding element 8 comprises a front guiding face 12 for guiding a wire to be connected between two subsequent contacts 2 of the three rows of contacts. To this end the guiding face 12 extends transverse to the holder along at least the width of the holder 5 and is the guiding face 12 located between those two subsequent contacts 2 of the rows of contacts, of which one contact 2 is aligned with the corresponding tool 6 or 7, respectively and has its contact pin part 3 projecting into the corresponding guiding slot 11 and of which the other contact 2 has its contact pin part 3 outside of the guiding slot 11. The first guiding element 8 is further provided with a side guiding face 14 and a freely projecting lip 15 with a horizontal guiding face 16 joining the side guiding face 14. The side guiding face 14 joins the front guiding face 12 and extends mainly in the direction of movement of the holder 5 and extends from the base face 10 obliquely upwardly and away from the holder 5.

Figure 5:
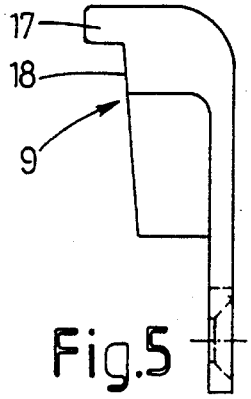
FIG. 5 shows a side view of the second guiding element of the apparatus according to FIGS. 1–4.

In order to facilitate the correct positioning of the wire to be connected the second guiding element 9 is provided, a side view of which is shown in FIG. 5. This second guiding element 9 is somewhat L-shaped wherein the short leg 17 is directed towards the first element 8. The second guiding element has a guiding face 18 for guiding a wire to be connected which is already guided along the guiding faces 12, 14 and 16 of the first guiding element The guiding face 18 brings the wire into a position aligned with the corresponding tool 6 so that the wire can be connected to the opposite contact 2. With respect to the front guiding face 12 of the first guiding element 8 the guiding face 18 is lying at a larger distance from the holder 5 and is directed opposite to the front guiding face 12.

The apparatus described operates as follows.

The cable 19 with wires 20 which must be connected to the different contacts 2 is placed in a schematically shown clamp 21 in a usual manner. The wires 20 are only schematically indicated in the drawing wherein in practice there is of course sufficient free length available to connect the wires with the contacts. For wiring the connector 1 with three rows of contacts 2 shown in FIGS. 1 and 2 the central row and the left row of contacts 2 are first connected with wires 20, the connector part 4 being absent yet. When the connector 1 is located with two contacts 2 aligned with the tools 6 and 7, respectively, the wire 20 for the right contact is placed in a usual manner in an wire guiding slot 22. The wire 20 for the contact 2 of the central row is guided under the lip 15 along the guiding face 16, the side guiding face 14 and the front guiding face 12. Subsequently the wire 20 is moved through the space 23 between the first guiding element 8 and the second guiding element 9 and along the guiding face 18 of the second guiding element 9 towards an wire guiding slot 24 aligned with the tool 6. During this movement the wire 20 is pulled downwards and is guided automatically between the two subsequent contacts 2 of the central and left rows by the guiding faces 14 and 12 of the first guiding element. The projecting contact pin parts 3 cannot be bent by the wire 20 because these contact pin parts 3 are supported by the guiding slots 11. When both wires 20 are in the correct position, the tools 6, 7 can connect the wires to the contacts 2.

After all wires are connected to the central and left rows, the connector part 4 with the right row of contacts 2 is provided and the contacts thereof are provided with wires in the same manner as for the central row of contacts 2.

It is noted that the apparatus of FIGS. 1 and 2 can also be used for wiring a connector 1 having only two rows of contacts 2.

Figure 3:
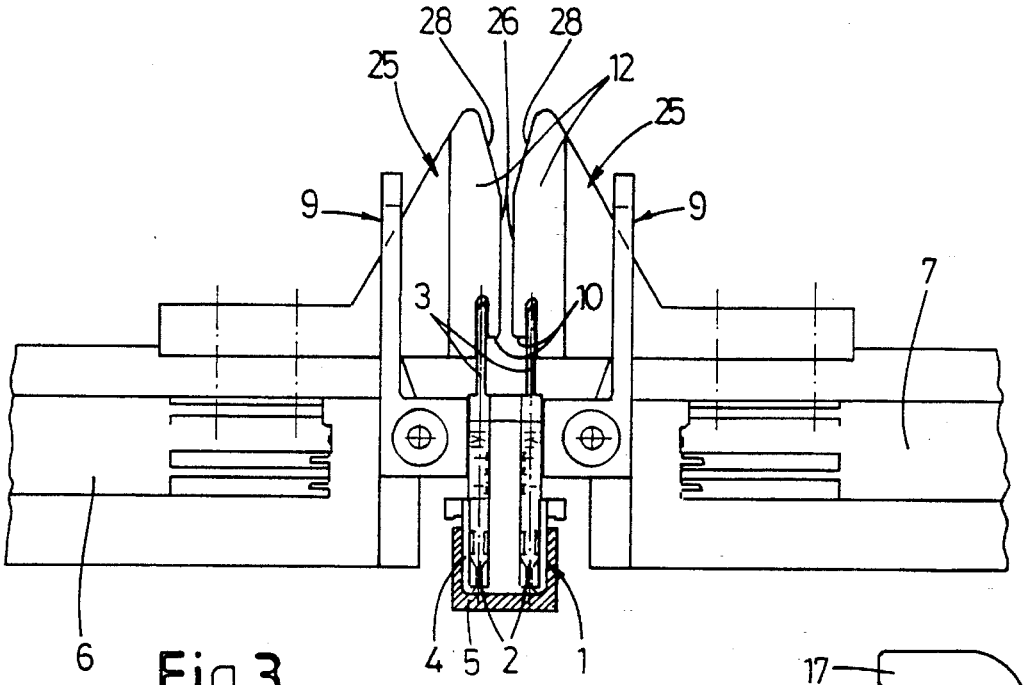
FIG. 3 shows rather schematically a front view of a second embodiment of the apparatus according to the invention.
Figure 4:
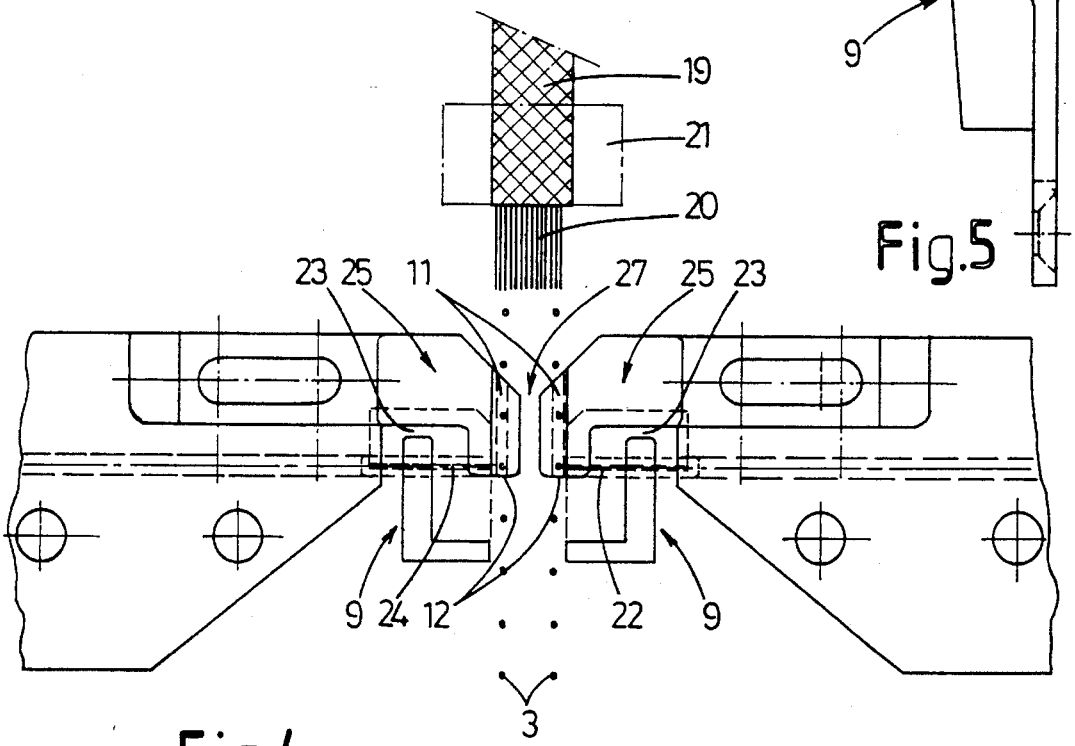
FIG. 4 shows a top view of the apparatus of FIG. 3.

With the apparatus shown in FIGS. 1 and 2 all wires 20 of the cable 19 are applied to the rows of contacts 2 from one longitudinal side. In FIGS. 3 and 4 there is shown an alternative embodiment wherein the wires 20 of the cable 19 are provided centrally between two rows of contacts 2.

To this end the apparatus of FIGS. 3 and 4 is provided with two mirror symmetrical first guiding elements 25 mounted on both sides of the centre of the holder 5. These mirror symmetrical first guiding elements each cooperate with a second guiding element 9 according to FIG. 5 wherein however the right guiding element 9 is the mirror image.

In the same manner as the guiding element 8 the guiding elements 25 each are provided with a base face 10 with a guiding slot 11 for guiding projecting contact pin parts 3 of the rows of contacts 2.

Further each guiding element 25 has a front guiding face 12 located in the same manner as the front guiding face 12 of the guiding element 8. The guiding elements 25 comprise side guiding faces 26 facing each other and joining the corresponding front guiding face 12 and determining together a feeding slot 27 for wires to be connected, said feeding slot extending substantially centrally above the holder 5. As the side guiding faces 26 each have an obliquely extending part 28 the wires 20 can be easily introduced into the slot 27.

The apparatus according to FIGS. 3 and 4 operates as follows.

The cable 19 of which the wires 20 must be connected to the contacts 2 is fixed in the cable clamp 21. A wire 20 for the left row of contacts is introduced into the slot 27 and is guided along the side guiding face 26 and the front guiding face 12 of the left guiding elements 25 and is pulled downwardly through the space 23 between the guiding element 25 and the guiding element 9 along the guiding face 18 into the wire guiding slot 24 in a position aligned with the tool 6. In a corresponding manner the wire 20 for the right row of contacts is guided along the side guiding face 26 and the front guiding face 12 of the right guiding element 25 and is pulled downwardly through the space 23 along the guiding face 18 to the wire guiding slot 22 in a position aligned with the tool 7.

By the guiding faces 12 and 26 the wires 20 are automatically guided between two subsequent contacts 2, wherein the contact pin parts 3 cannot not bent because these parts are supported in the guiding slots 11.

When the wires 20 are located in the correct position, the tools 6, 7 can connect the wires 20 to the contacts 2.

From the foregoing it will be clear that the invention makes it possible to adapt a usual apparatus for wiring connectors of the IDC type for wiring stackable connectors of the IDC type by means of simple auxiliary pieces in the form of the guiding elements 8, 9 and 25. The guiding elements 8, 9 and 25 can be mounted easily on an existing apparatus by means of bolts so that the apparatus can be used for wiring different types of connectors by means of these guiding elements.

The invention is not restricted to the above described embodiments which can be varied in a number of ways within the scope of the claims.

I claim:

1. Apparatus for wiring an electrical connector with two or more rows of subsequent contacts, the apparatus comprising a movable holder for the connector, at least one tool for applying at least one wire in at least one of the contacts aligned with the tool, said tool being movable back and forth transverse to said holder, means for moving the holder in steps in such a manner that the subsequent contacts in at least one of the rows of contacts are step-wise advanced and aligned with the tool, a first guiding element having a base face with at least one guiding slot for guiding projecting contact pin parts of the contacts located in said holder, said guiding slot extending in a direction of movement of the holder above the holder, a front guiding face for guiding the wire, said front guiding face extending transverse to the holder along a width of the holder between two of the contacts when one of these two contacts is aligned with the tool and having its contact pin part extending into the corresponding guiding slot, and a side guiding face joining the front guiding face for guiding the wire, said side guiding face substantially extending in the direction of movement of the holder and extending from the base face obliquely upwardly and away from the holder.

2. Apparatus according to claim 1, wherein the guiding element is provided with a lip freely projecting and having a horizontal guiding face joining said oblique side guiding face.

3. Apparatus according to claim 1 wherein a second generally L-shaped guiding element is provided at each first guiding element, a short leg of said second guiding element being directed towards the first guiding element and provided with a second guiding face for guiding the wire, which is guided along the guiding faces of the first guiding element, towards a position aligned with the tool, said second guiding face being staggered transverse to the holder with respect to the front guiding face of the corresponding first guiding element and being directed opposite to the front guiding face.

4. Apparatus for wiring an electrical connector with two or more rows of subsequent contacts, the apparatus comprising a movable holder for the connector, at least one tool for applying wires in the contacts of the connector when aligned with the tool, said tool being movable back and forth transverse to said holder, means for moving the holder in steps in such a manner that the subsequent contacts in the rows of the connector are step-wise advanced and aligned with the tool after each step, two mirror symmetrical first guiding elements each having a base face with at least one guiding slot for guiding projecting contact pin parts of at least one of the rows of contacts located in the holder, said guiding slots extending in a direction of movement of the holder above the holder, said guiding elements each having a front guiding face for guiding wires and extending transverse to said holder between two of the subsequent contacts of one of the rows of contacts when one of these two contacts are aligned with the tool and having its contact pin part extending into the corresponding guiding slot, wherein said guiding elements have facing side guiding faces each joining the corresponding front guiding face and determining together a feeding slot for the wires, said feeding slot being located substantially centrally above the holder.

* * * * *